US005914209A

United States Patent [19]

Grushkin

[11] Patent Number: 5,914,209

[45] Date of Patent: Jun. 22, 1999

[54] SINGLE DEVELOPMENT TONER FOR IMPROVED MICR

[75] Inventor: Bernard Grushkin, Pittsford, N.Y.

[73] Assignee: Xerox Corporation, Stamford, Conn.

[21] Appl. No.: 07/702,533

[22] Filed: May 20, 1991

[51] Int. Cl.[6] ..... G03G 9/083

[52] U.S. Cl. ..... 430/106.6; 430/110

[58] Field of Search ..... 430/106.6, 903, 430/111, 106, 110

[56] References Cited

U.S. PATENT DOCUMENTS

| | | | |
|---|---|---|---|
| 3,829,314 | 8/1974 | Shelffo | 96/1.4 |
| 3,854,975 | 12/1974 | Brenneman et al. | 117/21 |
| 3,873,325 | 3/1975 | Westdale | 96/150 |
| 3,925,219 | 12/1975 | Strong | 252/62.1 |
| 4,022,738 | 5/1977 | Shimada et al. | 260/28 |
| 4,100,087 | 7/1978 | Takayama et al. | 252/62.1 |
| 4,108,653 | 8/1978 | Peters | 96/1 |
| 4,206,247 | 6/1980 | Mitsuhashi et al. | 430/120 |
| 4,262,077 | 4/1981 | Ito | 430/107 |
| 4,355,088 | 10/1982 | Westdale et al. | 430/98 |
| 4,385,107 | 5/1983 | Tanaka et al. | 430/98 |
| 4,391,893 | 7/1983 | Hendriks | 430/137 |
| 4,517,268 | 5/1985 | Gruber et al. | 430/39 |
| 4,529,680 | 7/1985 | Asanae et al. | 430/106.6 |
| 4,535,049 | 8/1985 | Honda et al. | 430/137 |
| 4,612,272 | 9/1986 | Westdale | 430/98 |
| 4,612,273 | 9/1986 | Westdale et al. | 430/98 |
| 4,758,490 | 7/1988 | Kitabatake | 430/106 |
| 4,758,493 | 7/1988 | Young et al. | 430/122 |
| 4,803,143 | 2/1989 | Ostertag et al. | 430/106.6 |
| 4,994,340 | 2/1991 | Yamazaki et al. | 430/106.6 |
| 5,034,298 | 7/1991 | Berkes et al. | 430/110 |

FOREIGN PATENT DOCUMENTS

| | | |
|---|---|---|
| 2181757 | 7/1990 | Japan . |

*Primary Examiner*—John A. McPherson
*Assistant Examiner*—Rosemary Ashton
*Attorney, Agent, or Firm*—Kenyon & Kenyon

[57] ABSTRACT

The use of a mixture of hard and soft magnetites as well as a lubricating wax in the formulation of single component developers is disclosed. The mixture allows for sufficient high remenance for MICR applications without high levels of magnetite loadings that can adversely affect the toner rheological properties and at the same time reduce sorter image abrasion.

4 Claims, 2 Drawing Sheets

FIGURE 1 READER /SORTER REJECT RATE AS A FUNCTION OF PERCENT CRYSTALLINE WAX IN TONER
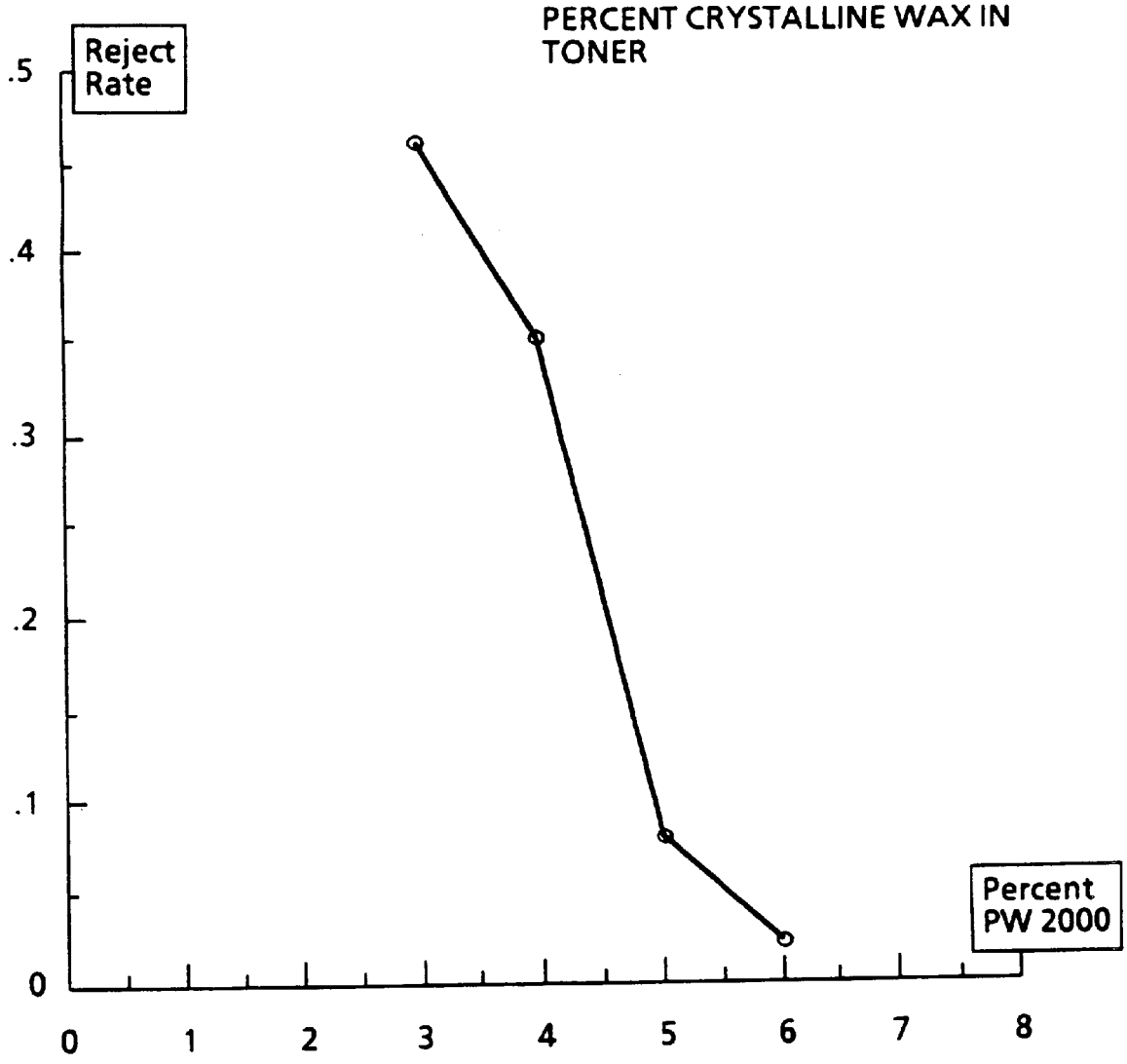

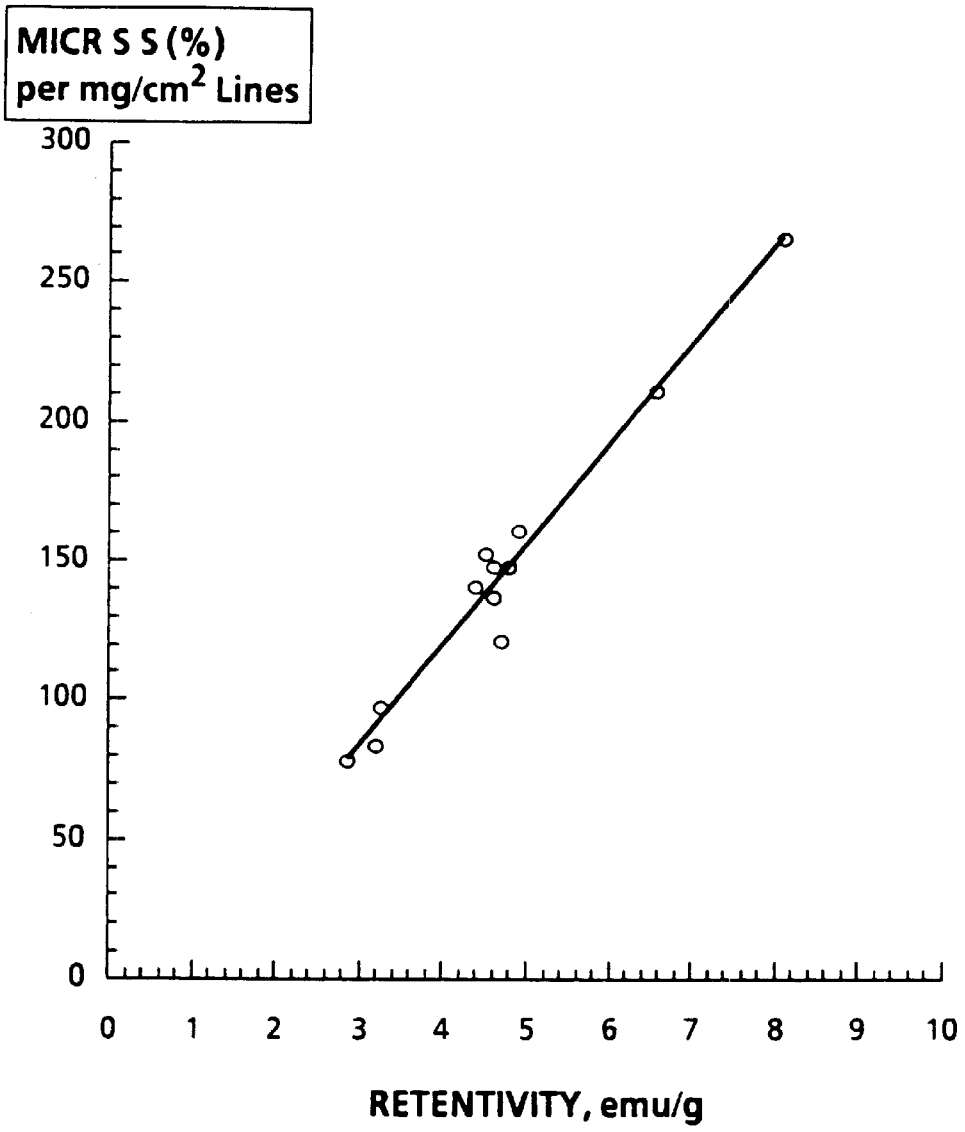
Figure 2: MICR SIGNAL STRENGTH, NORMALIZED FOR TRANSFERRED MASS, AS A FUNCTION OF RETENTIVITY AT 1K Oersted.

SINGLE DEVELOPMENT TONER FOR IMPROVED MICR

FIELD OF THE INVENTION

The present invention relates generally to improved toner compositions for use in generating documents suitable for magnetic image character recognition. In particular, the present invention relates to improved toner compositions containing magnetite materials.

BACKGROUND OF THE INVENTION

The formation and development of images on the surface of photoconductive materials by electrostatic means is well known. The basic xerographic process, as taught by C. F. Carlson in U.S. Pat. No. 2,297,691, involves placing a uniform electrostatic charge on a photoconductive insulating layer, exposing the layer to a light and shadow image to dissipate the charge on the areas of the layer exposed to the light and developing the resulting latent electrostatic image by depositing on the image a finely—divided electroscopic material referred to in the art as "toner". The toner will normally be attracted to those areas of the layer which retain a charge, thereby forming a toner image corresponding to the latent electrostatic image. This powder image may then be transferred to a support surface such as paper. The transferred image may subsequently be permanently affixed to the support surface as by heat. Instead of latent image formation by uniformly charging the photoconductive layer and then exposing the layer to a light and shadow image, one may form the latent image by directly charging the layer in image configuration. Thereafter, the powder image may be fixed to the photoconductive layer is elimination of the powder image transfer step is desired. Other suitable fixing means such as solvent or overcoating treatment may be substituted for the foregoing heat fixing step.

Some developer and toner compositions with certain waxes therein are known. For example, there are disclosed in U.K. Patent Publication 1,442,835 toner compositions containing resin particles, and polyalkylene compounds, such as polyethylene and polypropylene of a molecular weight of from about 1,500 to 6,000, reference page 3, lines 97 to 119, which compositions prevent toner offsetting in electrostatic imaging processes. Additionally, the '835 publication discloses the addition of paraffin waxes together with, or without a metal salt of a fatty acid, reference page 2, lines 55 to 58. In addition, many patents disclose the use of metal salts of fatty acids for incorporation into toner compositions, such as U.S. Pat. No. 3,655,374. Also, it is known that the aforementioned toner compositions with metal salts of fatty acids can be selected for electrostatic imaging methods wherein blade cleaning of the photoreceptor is accomplished, reference Palmeriti et al. U.S. Pat. No. 3,635,704, issued Jan. 18, 1972, the disclosure of which is totally incorporated herein by reference. Additionally, there are illustrated in U.S. Pat. No. 3,983,045 three component developed compositions comprising toner particles, a friction reducing material, and a finely divided nonsmearable abrasive material, reference column 4, beginning at line 31. Examples of friction reducing materials include saturated or unsaturated, substituted or unsubstituted, fatty acids preferably of from 8 to 35 carbon atoms, or metal salts of such fatty acids; fatty alcohols corresponding to said acids; mono and polyhydric alcohol esters of said acids and corresponding amides; polyethylene glycols and methoxy-polyethylene glycols; terephthalic acids; and the like, reference column 7, lines 13 to 43.

U.S. Pat. No. 4,952,476 discloses a magnetic toner comprising a binder resin, magnetic powder and 0.1–10 wt. % of a low-molecular weight polyakylene. The binder resin comprises a vinyl-type polymer having 5 to 80 wt. % of a tetrahydrofuran-insoluble. Retentivity of such compositions is summarized in FIG. 3 of the patent.

According to a published abstract, Japanese application number 64-1332 discloses a magnetic toner formed by incorporating a spherical magnetic material and a "needle" magnetic material in a ratio of 95:5 to 75:25.

Described in U.S. Pat. No. 4,367,275 are methods of preventing offsetting of electrostatic images of the toner compositions to the fuser roll, which toner subsequently offsets to supporting substrates such as papers wherein there are selected toner compositions containing specific external lubricants including various waxes, see column 5, lines 32 to 45, which waxes are substantially different in their properties and characteristics than the polymeric alcohol waxes selected for the toner and developer compositions of the present invention; and moreover, the toner compositions of the present invention with the aforementioned polymeric alcohol additives possess advantages, such as elimination of toner spotting, not achievable with the toner and developer compositions of the '275 patent.

In a Petrolite, Inc. brochure, dated 1985 there are disclosed polymeric hydroxy waxes, which brochure indicates that the waxes may have utility in toner compositions. Other references of interest which disclose, for example, the use of amides as toner additives include U.S. Pat. Nos. 4,072,521; 4,073,649; and 4,076,641. Furthermore, references of background interest are U.S. Pat. Nos. 3,165,420; 3,236,776; 4,145,300; 4,271,249; 4,556,624; 4,557,991; and 4,604,338.

Toner and developer compositions containing charge enhancing additives, especially additives which impart a positive charge to the toner resin, are known. Thus, for example, there is described in U.S. Pat. No. 3,893,935 the use of certain quaternary ammonium, salts as charge control agents for electrostatic toner compositions. There is also described in U.S. Pat. No. 2,986,521 reversal developer compositions comprised of toner resin particles coated with finely divided colloidal silica. According to the disclosure of this patent, the development of images on negatively charged surfaces is accomplished by applying a developer composition having a positively charged triboelectric relationship with respect to the colloidal silica. Further, in U.S. Pat. No. 4,338,390, the disclosure of which is incorporated herein by reference, developer and toner compositions having sulfate and sulfonate components are illustrated. In U.S. Pat. No. 4,298,672, the disclosure of which is also incorporated by reference, positively charged toner compositions containing resin particles and pigment particles and alkyl pyridinium compounds (including cetyl pyridinium chloride) as charge enhancing additives.

Magnetic ink printing methods with inks containing magnetic particles are known. For example, there is disclosed in U.S. Pat. No. 3,998,160 that various magnetic inks have been used in printing digits, characters, or artistic designs, on checks or bank notes. The magnetic ink used for these processes consists of acicular magnetic particles, such as magnetite in a fluid medium, and a magnetic coating of ferric oxide, chromium dioxide, or similar materials dispersed in a vehicle comprising binders, and plasticizers, according to the disclosure of the '160 patent. It is further disclosed in this patent that there is provided a method of printing on a surface with an ink including acicular magnetic particles in order that the authenticity of the printing can be verified, wherein a pattern is formed on a carrier with the ink in the wet state, and wherein the particles are subjected to a magnetic aligning process while the ink is on the carrier. Subsequently, the wet ink is transferred to the surface, which transfer is accomplished with substantially aligned particles according to the teachings of this patent.

British Pat. No. 1,183,479 discloses a method of orienting magnetic particles in a liquid prior to the deposition of the liquid on a tape media, while British Pat. No. 1,331,604 relates to the recording of information, especially security information, onto cards having magnetic layers thereon. The cards according to the '604 patent, are provided with a magnetic water mark by orienting preselected areas of a coating consisting of acicular magnetic particles in a binder, while the coating is in a liquid state, followed by causing the coating to solidify.

Disclosed in U.S. Pat. No. 4,128,202 is a device for transporting a document that has been mutilated or erroneously encoded wherein there is provided a predetermined area for the receipt of correctly encoded magnetic image character recognition information (MICR). As indicated in this patent, the information involved is referred to as MICR characters, which characters appear, for example, at the bottom of personal checks as printed numbers and symbols. These checks have been printed in an ink containing magnetizable particles therein, and when the information contained on the document is to be read, the document is passed through a sorter/reader which first magnetizes the magnetizable particles, and subsequently detects a magnetic field of the symbols resulting from the magnetic retentivity of the ink. The characters and symbols involved, according to the '202 patent are generally segregated into three separate field, the first field being termed a transient field, which contains the appropriate symbols and characters to identify the bank, bank branch, or the issuing source. The second field contains the account affected by the transactions, and the third field, which cannot be pre-recorded indicates the amount of the check. Typically, the first two fields are preencoded, that is they can be placed on the check document prior to the bank or issuing source sending the checks to the customer for use. However, after the check has been presented to the bank for payment, and is processed through various data processing systems, the amount of the check must be encoded at the appropriate location, this latter step being referred to as post encoding. Post encoding is typically accomplished with special encoding machines having a keyboard operated by an individual who generally observes the amount written on the check, and encodes the amount in MICR characters in the amount field of a clear band for example.

Additional, there is disclosed in an Anser Company Bulletin, published about Jun. 1, 1983, a printer for checks and forms based on ion deposition imaging. According to the description contained in this publication, the Anser I printing technology allows for the printing of checks by generating a cloud of free ions in a charging chamber by means of a high frequency electric field, and subsequently introducing a second field for the purpose of accelerating a small portion of these ions through a very small hole into the dielectric surface of an imaging cylinder. Development is then apparently accomplished by applying toner to the charged image, followed by transfer and fixing to a substrate such as paper. Apparently, fixing is accomplished by cold pressure fusing, thus single component toner particles are selected.

In U.S. Pat. No. 4,517,268, the disclosure of which is totally incorporated herein by reference, there is illustrated a process for generating documents such as personal checks suitable for magnetic image character recognition, which process involves generating documents in high speed electronic laser printing devices. The developer composition disclosed in this patent is comprised of, for example, magnetic particles, such as magnetite, certain styrene resin particles, and the carrier particles as illustrated in the Abstract of the Disclosure. Additive particles may also be included in the developer compositions of this patent.

It has previously been determined that toners having 40–50% soft magnetites give good development with little background. Generally magnetites are of three types: (1) cubic or soft; (2) octahedral; and (3) acicular or hard. Cubic magnetites are the least expensive. As previously discussed in part, certain toner compositions containing magnetites are known. U.S. Pat. No. 4,517,268 discloses a magnetic toner composition having about 20 to 70 weight percent of magnetite particles and about 30 to 80 weight percent of toner resin particles. The magnetites may be hard, soft or a mixture thereof. U.S. Pat. No. 4,939,060 teaches a magnetic toner composition having a binder resin and a magnetic powder. The magnetic powder is made of spherical magnetic particles that may include iron oxides such as magnetite. U.S. Pat. No. 4,946,755 discloses a magnetic toner composition having 40 to 80 percent of a binder resin, 20 to 60 percent of iron oxide having an average particle size of 0.2 to 0.7 microns. The iron oxide may be magnetite. U.S. Pat. No. 4,859,550 teaches that hard or soft magnetites may be incorporated into the toner from about 35–70%.

In applications requiring MICR capabilities, toners must contain magnetites having specific properties, the most important of which is a high enough level of remanence or retentivity. Retentivity is a measure of the magnetism left when the magnetite is removed from the magnetic field, i.e., the residual magnetism. In applications requiring MICR capability, it is important for the toner to show a high enough retentivity such that when the characters are read, the magnetites produce a signal. This is the signal strength of the toner composition. The magnetic signal level is of substantial importance in MICR systems. The signal level can vary in proportion to the amount of toner deposited on the document being generated. Signal strength of a toner composition can be measured by using known devices, including the MICR-Mate 1, manufactured by Checkmate Electronics, Inc.

Effective MICR toner compositions must have magnetic characteristics which meet banking industry requirements for character signal strength. Each MICR character has its own unique toner content due to the differing shape and configuration of each character. In a typical signal strength test, a MICR-Mate 1 reading device is calibrated to read the "on-us" character as 100% signal strength. The relative signal strength of test characters for a given toner composition are then measured by reading them with the calibrated device. Each test character will read more or less than 100% signal strength. Generally, a relative signal strength of 125–150% is desirable. However, different banking organizations have different standards for what constitutes an acceptable signal strength to deter excessive document rejection rates. For example, the U.S. (ANSI) standard is 70–200%, while the Canadian standard is 100–200%.

Toner compositions used in single component development ("SCD") applications, i.e., those having 40–50% soft magnetites, typically have a low retentivity and a low signal strength. Often the signal strength and the retentivity of these toner compositions is too low to meet the stringent requirements of the industries utilizing MICR applications, e.g. the banking industry. Soft or cubic magnetites give a low retentivity while octahedral and acicular magnetites give a high retentivity. Therefore, in past toner composition have been comprised high levels of, or entirely of, acicular magnetites to provide the desired retentivity. However, the use of a toner composition having all acicular magnetites is very expensive. Toners employing only acicular magnetites have also exhibited signal strengths that are too high.

SCD toners generally use soft (spherical or cubic) magnetites wherein $\rho_R$ at saturation is less than 15 emu/g. Such magnetites, when present in the toner from 30–60%, will provide sufficient magnetic moment to satisfy the xerographic development requirements. However, the toner retentivity may be insufficient to satisfy MICR signal strength requirement due to the presence of soft magnetites. Although this problem can be overcome by increasing the loading of soft magnetite beyond 50%, the higher loadings of magnetite can result in low optical density and impact other toner properties such as increased fines content during micronization, increased minimum fusing temperature, higher dielectric dissipation factor and result in free magnetite on the toner surface. Conversely, if only hard magnetite is used (wherein $\rho_R$ is greater than 25 emu/g) and the xerographic development is satisfied to obtain adequate line and solid area density (SAD) without background, the signal strength is too high and unacceptable for MICR application.

A further problem for SCD toner compositions which contain the requisite high level of magnetites for use in MICR applications is that printed characters in such applications exhibit an inordinate degree of abrasion after multiple passes through a reader/sorter. Such wear can degrade MICR characters to the point that the document is rejected by the sorter. Also, toner abrasion results in contamination of the sorter read/write heads which is not only cosmetically objectionable but also can result in false readings. It had been found that the wearability of the MICR characters can be substantially improved by incorporating a wax in the toner. U.S. Pat. No. 4,859,550 (which is incorporated herein by reference) discloses that the addition of certain polymeric waxes minimizes image smearing. The '550 patent also teaches that hard or soft magnetites can be incorporated in the toner.

A further reason for incorporating wax into a toner composition is to use the wax as a fusing release agent. In most SCD systems, once the toner is put on the paper, the paper is then passed through a fuser. The fuser roll contains release oil which keeps the toner from sticking to the roll. The incorporation of wax into the toner composition eliminates the need for release oil because the wax functions as a release agent.

There is therefore a need to provide a SCD toner formulation which will obtain a sufficiently high retentivity for MICR applications without the high levels of magnetite loadings that could adversely affect the toner rheological properties and contribute to higher toner cost. At the same time, the toner formulation should reduce sorter image abrasion and improve resistance of MICR characters to wear.

SUMMARY OF THE INVENTION

The present invention is generally directed to imaging processes with toner and developer compositions, and more specifically the present invention is directed to imaging and printing processes with magnetic single component developer ("SCD") compositions particularly useful for generating documents such as personal checks which are subsequently processed by magnetic ink character recognition ("MICR") processes in reader/sorters. These processes are typically used to generate documents, such as checks, including for example dividend checks, turn around documents such as invoice statements like those submitted to customers by American Express and VISA, corporate checks, highway tickets, rebate checks, other documents with magnetic codes thereon, and the like.

The process is particularly applicable to the generation of documents including personal checks, which have been fused with soft roll fusers. Fuser rolls such as silicon rolls or other conformable fuser rolls, reference for example the soft fuser rolls incorporated into the Xerox Corporation 4040™ machine, are particularly useful with the processes of the present invention.

The documents, including the personal checks mentioned herein, can be obtained, for example, by generating a latent image thereon and subsequently developing the image (reference U.S. Pat. No. 4,517,268, the disclosure of which is totally incorporated herein by reference) with the toner and developer compositions illustrated herein. The developed image that has been created, for example, in the Xerox Corporation 9700™ MICR printer contains thereon the characters zero, 1, 2, 3, 4, 5, 6, 7, 8, and 9, and up to four symbols (E-13B and CMC-7 font), which characters are magnetically readable by the IBM 3890™, or other similar apparatus. Other MICR reader/sorters include the commercially available IBM 3890™, NCR 6780™, reader/sorters from Burroughs Corporation, and the like.

The present invention, which in one embodiment is directed to SCD toner, is a toner formulation containing a resin, a mixture of hard and soft magnetites, a lubricating wax for reducing sorter image abrasion and a charge enhancing additive. The surface of such toner is treated with a flow aid to improve powder flow. Preferred toner formulations have a retentivity at 1K Oersted of from about 3.0 to about 8.0 emu/g and preferably from 4.0 to 6.0 emu/g. Acceptable reader/sorter signal strength can be achieved for all characters without excessive deposition of toner on the document.

The present toner formulation contains from about 30 to about 70 percent (preferably about 30 to about 60 percent) by weight of a polymer resin. The resin of the present toner formulation can be bimodal, i.e., contain both a low molecular weight component of from about 3,000 to about 30,000 molecular weight and a high molecular weight component of from about 300,000 to about 1,200,000 molecular weight in a weight ratio of from about 10 to about 60 percent low molecular weight component. The two components are responsible for providing a minimum fusing temperature (preferably of from about 350 to about 380° F.) and the hot offset temperature (of from about 400 to about 430° F.) when measured in a xerographic copier (such as the Xerox 1012 Copier™). Preferred examples and descriptions of resins, designated A–D, which may be used in the present invention are found in Table 1. However, the resin is not limited to those described in Table 1 as any resin having the necessary properties can be used. A number of known toner resins can be selected such as styrene acrylates, styrene methacrylates, styrene-butadiene, polyesters and the like (such as those disclosed in U.S. Pat. Nos. 4,971,882, 4,954,408, 4,904,762, 4,883,736, 4,122,024, 4,298,672, 4,338,390 and 3,590,000, the disclosures of which are fully incorporated herein by reference). One preferred resin is a styrene-n-butyl acrylate copolymer having a styrene-n-butyl acrylate copolymer monomer weight ratio of about 85:15 and an average molecular weight of about 260,000.

TABLE 1

| RESINS | |
|---|---|
| DESIGNATION | DESCRIPTION |
| A | Styrene-n-butyl acrylate copolymer with a sty/nBA monomer weight ratio of 85/15, an average molecular weight of 260,000 and an MWD of 55. |
| B | Styrene-2-ethylhexyl acrylate copolymer with monomer weight ratio of 89/11, an average molecular weight of 320,000 and an MWD of 25. |
| C | Pliotone 1010, a styrene-butadiene copoloymer from Goodyear Tire & Rubber Co. |
| D | Crosslinked polyester resin prepared from propoxylated bisphenol-A and fumaric acid containing 15 weight percent gel. |

The total magnetite present in the toner formulation is from about 30% to about 60%, preferably from about 40% to about 50% of the total composition. If the composition contains less than about 30% total magnetite, the risk of the toner producing a high background increases. If the composition contains more than about 60% total magnetite, the risk of not developing enough toner increases. Sufficient MICR signal strength can be obtained with less than 50% magnetite, and yet the formulation satisfies the magnetics required of the toner for xerographic development.

The advantages of using less than 50% of mixed magnetite in SCD toner are:

1) Significant reduction in the amount of magnetite adhering to the surface of toner particles.

2) Lower dielectric dissipation factor.

3) Flexibility and better control of the MICR signal strength. Generally, the total magnetite combination contains up to about 10% of hard magnetite, which has been found sufficient to boost retentivity of the toner. Thus, about 10% of hard magnetite is sufficient to provide the toner formulation with the necessary xerographic properties for MICR applications in SCD.

Examples and descriptions of types of magnetites used in the present formulation are found in Table 2. Preferred magnetites useful in the toner composition of the present invention are acicular magnetites (commercially available from Pfizer as MO4431 and MO4232 and from Magnavox as B-350), cubical magnetites (commercially available from Harcros as MO7029 and from Magnavox as TMB-100), and Mapico Black (commercially available from Columbian Chemicals Co.). Other useful magnetites include polyhedral magnetites (commercially available from Hercules Incorporation as EX 1601 and XMT 100 and from Magnavox as TMB-102 and TMB-104). The formulation of the present invention is not limited to those magnetites described in Table 2 as any magnetite possessing similar properties of small particle size of less than 0.5 micron and retentivity at saturation of less than about 15 emu/g and greater than about 25 emu/g can be used in the formulation.

TABLE 2

| MAGNETITES | | | | | |
|---|---|---|---|---|---|
| | | | Magnetic Properties at 1000 Oe. | | |
| DESIGNATION | SOURCE | DESCRIPTION | $O_m$ | $O_r$ | $H_c$ |
| MB22 | Titan Kogyo | Cubic magnetite | 63.9 | 13.9 | 121.3 |
| Mapico Black | Columbian Chemicals Co. | Cubic magnetite | 69.7 | 14.8 | 80.7 |
| MO-7029 | Harcros Pigments, Inc. | Octahedral magnetite | 53.4 | 28.5 | 281.0 |
| MO-4232 | Harcros Pigments, Inc. | Acicular magnetite | 60.0 | 29.0 | 290.0 |

$O_m$, Specific Magnetization, emu/g
$O_r$, Remanent Magnetizaion, emu/g
$H_c$, Coercivity, Oersted The toner formulation also has a lubricating wax component, which is preferably a high density crystalline wax. The wax component helps reduce smear and image degradation during check handling in a reader/sorter. The formulation usually contains up to 10% wax, preferably from about 3% to about 6%. As shown in FIG. 1, if the formulation contains less than about 3% wax component, then the reject rate of the reader/sorter becomes too high. The wax can also serve as a fusing release agent when at least 2 weight percent is used. Examples and descriptions of waxes used in the present formulations are listed in Table 3. The wax component of the present formulation is not limited to those waxes described in Table 3 as any wax having similar properties associated with that of a highly crystalline low molecular weight wax (i.e., having a sharp melting point between about 85 and 135° C., and a melt viscosity of from about 2 cps to about 200 cps at between 100 and 150° C.) can be used.

TABLE 3

| WAXES | | |
|---|---|---|
| DESIGNATION | SOURCE | DESCRIPTION |
| 660 P | Sanyo Chem. Ind., Ltd. | Low molecular weight polypopylene wax |
| PW2000 (Polywax 2000) | Petrolite Speciality Pol. Group | High density linear polyethylene, 2000 molecular weight. |
| PW3000 (Polywax 3000) | Petrolite Specialty Pol. Group | High density linear polyethylene, 3000 molecular weight. |
| Cerelube S-363 | Shamarock Technologies Inc. | Polypropylene copolymer |

Additionally, the present toner formulation may contain charge control additives and surface additives in amounts necessary for the toner to perform in specific applications, such as those listed in Tables 4 and 5. Suitable charge control additives include alkyl pyridinium halides, organic sulfonates, organic sulfates, organophosphonium halides, quaternary ammonium salts, naphthyl sulfonates and metal complex salts (such as those of aluminum, iron, zinc and chromium). Preferred additives include dimethyl distearoyl ammonium methyl sulfate, cetyl pyridinium chloride and "TRH" (a commercially available iron complex salt). The control additive is preferably present in an amount from about 0.1 to about 5%, most preferably about 0.5 to about 3%.

TABLE 4

CHARGE CONTROL ADDITIVES

| DESIGNATION | SOURCE | DESCRIPTION |
|---|---|---|
| Spilon Black TRH | Hodogaya | Metal complex dye |
| E-84 | Orient Chem. Ind., Ltd. | Metal complex dye |
| E-88 | Orient Chem. Ind., Ltd. | Metal complex dye |

TABLE 5

SURFACE ADDITIVES

| DESIGNATION | SOURCE | DESCRIPTION |
|---|---|---|
| TS-530 | Cabot Corp. | Hydrophobic silica |
| Aerosil R 972 | Degusa | Hydrophobic silica |

The toner compositions may also contain polyester or polystyrene resinous particles, such as styrene butadiene resins, commercially available as Pliolite®, styrene butylmethacrylate copolymer resins, styrene acrylate copolymers, such as styrene butylacrylate copolymer resins, and the like. Particularly preferred are toner resin particles containing from about 55 percent by weight of styrene to about 80 percent by weight of styrene, and from about 20 percent by weight of n-butylmethacrylate to about 45 percent by weight of n-butylmethacrylate, or styrene butadiene resins containing from about 85 percent by weight to about 95 percent by weight of styrene, and from about 5 percent by weight to about 15 percent by weight of butadiene.

There can also be incorporated into the magnetic toner composition of the present invention carbon black particles, in an amount of from about 0.1 percent by weight to about 10 percent by weight, and from about 0.3 percent by weight to about 0.7 percent by weight of colloidal silica particles, such as commercially available Aerosils (such as R812 and R972 from Degusa, which are hydrophobic silicas). These additives which are optional ingredients are added for a number of purposes, thus for example carbon black particles are added primarily for the purpose of imparting a deep black color to the toner resin particles. Also it is believed that the addition of carbon black particles favorably affects the triboelectric charging properties of the toner particles. The silica particles are added to the surface of the toner for the primary purpose of improving the flow of the toner particles, improving blade cleaning of the photoresponsive imaging surface, increasing the toner blocking temperature, and assisting in the charging of the toner particles.

BRIEF DESCRIPTION OF THE DRAWINGS

FIG. 1 is a graphic representation of how the reject rate from the reader/sorter depends on the percentage of wax in the toner formulation.

FIG. 2 is a graphic representation of how the measured signal strength of printed MICR characters depends of retentivity of the toner.

DETAILED DESCRIPTION OF PREFERRED EMBODIMENTS

The following examples further illustrate the invention; comparative data is also presented. Abbreviations used to list formulations correspond to those used in Tables 1–5.

EXAMPLE 1

A powder composition containing:

| | |
|---|---|
| Resin A | 53.0% |
| MB22 | 30.0% |
| MO4232 | 10.0% |
| TRH | 1.0% |
| PW2000 | 6.0% |

was intensely mixed then melt mixed in a roll mill. The resulting slab was then crushed and converted to toner size particles by air attrition. The toner was then classified to yield a usable toner fraction of from about 3 to about 20 microns. The surface of the classified toner was then surface treated with R972 silica (commercially available from Degusa) by intense mixing to improve powder flow properties and to increase the negative chargability of the toner.

This prepared single component toner was used in a Xerox 4030 Printer™ to produce MICR characters for further evaluation. Good image quality and resolution with very low background was obtained when the DC bias was 200–260 volts and 1600 VAC at 2400 Hz. Solid area densities were measured on a Macbeth Reflectance Densitometer. MICR signal strength for the "on-us" character was measured on a MICR-MATE 1.

As is shown in Table 6 and FIG. 2, the measured signal strength of printed MICR characters is directly related to the retentivity or remanence of the toner, which can be varied according to the ratio of hard and soft magnetite in the magnetite combination. The signal strength is also a function of the amount of toner deposited on the paper, which is dictated by xerographic development properties of the toner and the photoreceptor potentials, AC voltage and frequency that is superimposed on a DC bias. In Table 6, toner retentivity is stated in emu/g.

TABLE 6

PRINT TEST RESULTS

| Example No. | SAD | ON-US Signal Strength, % | Line Density mg/cm$^2$ | Signal Strength/ mg/cm$^2$ (lines) | Toner Retentivity at 1K Oe. emu/g. |
|---|---|---|---|---|---|
| Comp.1 | 1.25 | 115 | 1.47 | 78.2 | 2.85 |
| 1 | 1.36 | 140 | 1.15 | 121.7 | 4.7 |
| 2 | 1.24 | 143 | 0.93 | 153 | 4.5 |
| 3 | 1.38 | 137 | 1.00 | 137 | 4.6 |
| 4 | 1.0 | 280 | 1.05 | 267 | 8.12 |
| 5 | 0.9 | 210 | 0.99 | 212 | 6.58 |
| 6 | 1.24 | 94 | 0.96 | 98.0 | 3.24 |
| 11 | 1.44 | 163 | 1.10 | 148 | 4.79 |
| 8 | 1.22 | 97 | 1.15 | 84 | 3.20 |
| 9 | 1.40 | 145 | 0.98 | 148 | 4.60 |
| 10 | 1.10 | 175 | 0.92 | 161 | 4.90 |
| 11 | 1.25 | 148 | 0.95 | 141 | 4.40 |

EXAMPLES 2–6 AND COMPARATIVE EXAMPLE 1

Toner compositions for Examples 2–6 and Comparative Example 1 were formed according to the protocol described in Example 1, except that the formulations listed in Table 7 were used. The print test results of all the Examples are listed in Table 6. "TRH" listed in Table 7 is a charge control additive (commercially available from by Hodagaya, Inc. of Japan) which is an iron complex salt.

TABLE 7

TONER COMPOSITIONS

| Example | Resin | wt. % | Magnetite | wt. % | Charge Control Additive | wt. % | Wax | wt. % | Surface Additive | wt % |
|---|---|---|---|---|---|---|---|---|---|---|
| Comp Ex. 1 | A | 46.8 | MB22 | 50.0 | TRH* | 0.7 | 660 P | 2.5 | TS-530 | 1.2 |
| Ex. 1 | A | 53 | MB22 | 30.0 | TRH | 1.0 | PW2000 | 6.0 | TS-530 | 1.2 |
| | | | MO4232 | 10.0 | | | | | | |
| Ex. 2 | A | 54 | MB22 | 30 | TRH | 1.0 | PW2000 | 5.0 | TS-530 | 1.2 |
| | | | MO4232 | 10 | | | | | | |
| Ex. 3 | A | 56 | MB22 | 30 | TRH | 1.0 | PW2000 | 3.0 | TS-530 | 1.2 |
| | | | MO4232 | 10 | | | | | | |
| Ex. 4 | A | 58 | MB22 | 10.0 | TRH | 1.0 | PW2000 | 6.0 | TS-530 | 1.2 |
| | | | MO4232 | 25.0 | | | | | | |
| Ex. 5 | A | 58 | MB22 | 17 | TRH | 1.0 | PW2000 | 6.0 | R 972 | 0.8 |
| | | | MO4232 | 18 | | | | | | |
| Ex. 6 | A | 48 | MB22 | 42.75 | TRH | 1.0 | PW2000 | 6.0 | TS-530 | 1.2 |
| | | | MO4232 | 2.25 | | | | | | |

What is claimed is:

1. A toner composition comprising:

a) about 30% to about 70% by weight of a resin;

b) about 30% to about 60% by weight of a mixture of soft magnetite and hard magnetite; and c) up to about 10% by weight of a lubricating component; wherein said hard magnetite accounts for about 10% of the total weight of the toner composition, and wherein the retentivity of said toner composition is from about 3.0 emu/g to about 8.0 emu/g.

2. The toner composition of claim 1 wherein said hard magnetite is acicular magnetite.

3. The toner composition of claim 1 wherein said toner has retentivity of from 4 to about 6 emu/g.

4. The toner composition of claim 1 further comprising a charge control additive or surface additive.

* * * * *

UNITED STATES PATENT AND TRADEMARK OFFICE

CERTIFICATE OF CORRECTION

PATENT NO. : 5,914,209

DATED : 22 June 1999

INVENTOR(S) : Bernard GRUSHKIN

It is certified that error appears in the above-identified patent and that said Letters Patent is hereby corrected as shown below:

| Column | Line | |
|---|---|---|
| 1 | 21 | Change "finely–dived" to --finely-divided--. |
| 1 | 33 | After "layer" change "is" to --if--. |
| 2 | 54 | After "additives" insert --are illustrated--. |
| 3 | 32 | Change "field" to --fields--. |
| 3 | 50 | Change "Additional" to --Additionally--. |
| 4 | 51 | Change "strength" to --strengths--. |
| 5 | 1 | After "in" insert --the--; change "composition" to --compositions--. |
| 5 | 8 | Change "$\rho_R$" to --$\sigma_R$--. |
| 5 | 21 | Change "$\rho_R$" to --$\sigma_R$--. |

UNITED STATES PATENT AND TRADEMARK OFFICE

CERTIFICATE OF CORRECTION

PATENT NO. : 5,914,209

DATED : 22 June 1999

INVENTOR(S) : Bernard GRUSHKIN

It is certified that error appears in the above-identified patent and that said Letters Patent is hereby corrected as shown below:

| Column | Line | |
|---|---|---|
| 8 | 17 | Change "magnetizaion" to --magnetization--. |
| 9 | 59 | Change "depends of" to --depends on--. |
| 10 | 51-55 | Delete examples 7 to 11. |

Signed and Sealed this

Twentieth Day of June, 2000

*Attest:*

Q. TODD DICKINSON

*Attesting Officer*

*Director of Patents and Trademarks*